US005103518A

United States Patent [19]

Gilroy et al.

[11] Patent Number: 5,103,518

[45] Date of Patent: Apr. 14, 1992

[54] ALTERNATING PRESSURE PAD

[75] Inventors: Keith Gilroy, Upland; David C. Goetz, Ontario; George Harrigal, Redlands, all of Calif.

[73] Assignee: Bio Clinic Corporation, Rancho Cucamonga, Calif.

[21] Appl. No.: 388,114

[22] Filed: Aug. 1, 1989

[51] Int. Cl.[5] ..... A47C 27/08

[52] U.S. Cl. ..... 5/453; 5/455; 5/449

[58] Field of Search ..... 5/453, 455, 456, 457, 5/469, 464, 449

[56] References Cited

U.S. PATENT DOCUMENTS

| | | | |
|---|---|---|---|
| 2,437,006 | 3/1948 | Simpson | 128/33 |
| 2,669,987 | 2/1954 | Tonkin | 128/64 |
| 2,684,672 | 7/1954 | Summerville | 128/33 |
| 2,880,721 | 4/1959 | Corcoran | 128/39 |
| 2,998,817 | 9/1961 | Armstrong | 128/33 |
| 3,148,391 | 9/1964 | Whitney | 5/348 |
| 3,199,124 | 8/1965 | Grant | 5/349 |
| 3,297,023 | 1/1967 | Foley | 128/33 |
| 3,317,934 | 5/1967 | Hinrichs | 5/349 |
| 3,390,674 | 7/1968 | Jones | 128/33 |
| 3,394,415 | 7/1968 | Parker | 5/348 |
| 3,446,203 | 5/1969 | Murray | 128/24.2 |
| 3,462,778 | 8/1969 | Whitney | 5/347 |
| 3,467,081 | 9/1969 | Glass | 128/33 |
| 3,538,910 | 11/1970 | de Besme | 128/24 |
| 3,587,568 | 6/1971 | Thomas | 128/33 |
| 3,595,223 | 7/1971 | Castagna | 128/33 |
| 3,653,083 | 4/1972 | Lapidus | 5/348 |
| 3,674,019 | 7/1972 | Grant | 128/33 |
| 3,678,520 | 7/1972 | Evans | 5/453 |
| 3,701,173 | 10/1972 | Whitney | 5/349 |
| 3,920,006 | 11/1975 | Lapidus | 128/24.1 |
| 4,068,334 | 1/1978 | Randall | 5/365 |
| 4,149,541 | 4/1979 | Gammons et al. | 5/453 |
| 4,175,297 | 11/1979 | Robbins et al. | 5/284 |
| 4,197,837 | 4/1980 | Tringali et al. | 128/33 |
| 4,225,989 | 10/1980 | Corbett et al. | 5/453 |
| 4,267,611 | 5/1981 | Agulnick | 5/453 |
| 4,280,487 | 7/1981 | Jackson | 128/33 |
| 4,347,633 | 9/1982 | Gammone et al. | 5/453 |
| 4,391,007 | 7/1983 | Schild et al. | 5/453 |
| 4,454,615 | 6/1984 | Whitney | 5/449 |
| 4,472,847 | 9/1984 | Gammons et al. | 5/453 |
| 4,483,030 | 11/1984 | Flick et al. | 5/458 |
| 4,551,874 | 11/1985 | Matsumura et al. | 5/453 |
| 4,583,255 | 4/1986 | Mogaki et al. | 5/455 X |
| 4,653,130 | 3/1987 | Senoue et al. | 5/453 |
| 4,777,679 | 10/1988 | DeLooper | 5/453 |
| 5,010,608 | 4/1991 | Barnett et al. | 5/453 |

FOREIGN PATENT DOCUMENTS

| | | | |
|---|---|---|---|
| 2807038 | 8/1979 | Fed. Rep. of Germany | 5/455 |
| 2919438 | 11/1980 | Fed. Rep. of Germany | 5/453 |

*Primary Examiner*—Eric K. Nicholson
*Attorney, Agent, or Firm*—Christie, Parker & Hale

[57] ABSTRACT

An alternating pressure pad, useful between a mattress and a bed-ridden person for preventing the occurrence of bed sores, defines two separate sets of interdigitated transverse inflatable body support chambers. The support chambers are alternately inflated and deflated to provide alternating areas on his body where a person lying on the pad is supported by the pad. In a leg and foot section of the pad, the support chambers have a smaller inflated diameter than the other chambers of each set to provide effective support, and freedom from support, of the heel and ankle areas of the body when those chambers are alternately inflated at a pressure consistent with comfort of the person. A body air chamber is defined in the pad over and independent from the support chambers under a pad top sheet which has a predetermined portion of its area open for air to flow through it.

3 Claims, 5 Drawing Sheets

BLOOD FLOW (ML./MIN./100g. TISSUE)
0
1
2
3
4
5
6
TIME (SECONDS)
0 15 30 45 60 90 105 120 135 150 165 180 195 210 225 240 255 270 285 300 315 330 345 360 375 390 405 420 435 450 465 480
77
75
76
78

ALTERNATING PRESSURE PAD

FIELD OF THE INVENTION

This invention pertains to air-inflated, alternating pressure pads for use under a bed-ridden patient to prevent decubitus ulcers, i.e., bed sores. More particularly, it pertains to such a pad having improved arrangements for support of a patient's heels and for keeping a patient dry.

BACKGROUND OF THE INVENTION

Decubitus ulcers, commonly called "bed sores," occur in bed-ridden persons who cannot move sufficiently frequently in ways to relieve pressure upon the skin at locations on the body where there is very little tissue between a bone and the skin. The sacrum (base of the spine), trochanteric regions (the ends of the pelvis), ankles, and heels are places where bed sores most frequently occur; there are other places on the body where bed sores can occur. Bed sores occur where the surface supporting the body bears on the skin, as over a bony prominence of the body, to restrict capillary blood flow in the skin sufficiently that skin tone breaks down and open sores occur as a result. Bed sores can be prevented by periodically relieving body-supporting forces on the body in such places so that capillary flow can be reestablished enough to prevent serious loss of skin tone.

Air-inflated pads for preventing bed sores have been described in numerous patents and other publications, and are commercially available. Such pads can be considered to be a special class of air mattress in which two or more sheets of air-impermeable material, such as flexible synthetic plastic film, are secured together to define between them two or more sets of alternately located chambers. The several sets of chambers are coupled, as by separate air hoses, to an air supply device which operates to pressurize and inflate, at different times according to a desired schedule, the different sets of chambers in the pad. As one set of chambers is inflated, the other chambers are deflated. Such pads, commonly known as alternating pressure pads (sometimes also called alternate pressure pads), are placed between a bed-ridden person and the conventional mattress of the bed on which the person lies. In use of such pads, the locations where supporting forces are applied to the body are alternated in a cyclic manner on a schedule intended to allow constricted skin capillaries to reopen for blood flow through them long enough to maintain the skin in good condition before body supporting forces are reapplied to the skin for a time.

Alternating pressure pads previously constructed or described, as a rule, define the alternately inflatable chambers so that they are of substantially equal size (width or diameter) over the extent of the pad. Heretofore, it has not been effectively recognized that heels in particular are especially prone to the occurrence of bed sores, more so than other areas of the body, due to the large loads which heels support in a person lying on his back and due to the highly curved and projecting nature of the heel. There is a need for improvement in such pads in the areas thereof placed under the lower limbs of a person. To the extent previously constructed or described pads have arrangements for lower limb support different from torso and head support, they have not yet effectively addressed this need.

Also, alternating pressure pads cause persons supported on them to tend to become damp on those surfaces of their bodies facing the pads. This occurs because such a pad, being made of air-impermeable material, cannot breathe or permit air flow in the same manner as a conventional mattress can breathe or permit air flow. Body surfaces facing toward such a pad become hot, so the person perspires in those parts of his body and so becomes damp and uncomfortable. Also, skin dampness enhances the tendency for bed sores and other problems to develop. To counteract such problems, it is known to construct alternating pressure pads for flow of body cooling air from them toward the supported person by providing very small air flow holes through the top of the pad from at least some of the alternately inflatable body supporting chambers in the pad. It is also known to overlay such body cooling pads with a layer of foam rubber or the like to cause air discharged into the foam from the body supporting chambers to diffuse through the foam and to emerge over a larger area of the foam toward the patient, and at a lower velocity.

Previously known body cooling alternating pressure pads present several difficulties. Such a pad is always a body cooling pad. Very often, for any of a number of reasons, it may be desirable to cease the flow of body cooling air from the pad. That cannot be done without loss of the alternate pressure support function which is needed to prevent bed sores. It is therefore necessary to have two pads available, one with the body cooling function and one without that function, so that pads can be changed depending on whether body cooling is or is not needed. Pad changing can be distressing to the bed-ridden person and requires the services of at least one other person. A need exists for an alternating pressure pad which can be operated in cooling and non-cooling modes; such a pad, among other advantages, can be used under varying conditions which presently can be addressed only by the use of separate pads having and not having body cooling features.

THE PRIOR ART

Previously issued United States patents relating to alternating pressure pads, body cooling in such pads, and equipment for operating such pads include the following patents:

| | | |
|---|---|---|
| 2,437,006 | 3,446,203 | 4,068,334 |
| 2,669,987 | 3,462,778 | 4,175,297 |
| 2,684,672 | 3,467,081 | 4,197,837 |
| 2,880,721 | 3,538,910 | 4,225,989 |
| 2,998,817 | 3,587,568 | 4,267,611 |
| 3,148,391 | 3,595,223 | 4,280,487 |
| 3,199,124 | 3,653,083 | 4,347,633 |
| 3,297,023 | 3,674,019 | 4,454,615 |
| 3,317,934 | 3,701,173 | 4,472,847 |
| 3,390,674 | 3,920,006 | 4,483,030 |
| 3,394,415 | | |

SUMMARY OF THE INVENTION

This invention addresses the needs identified above. It does so by providing an alternating pressure pad which treats support of the foot and lower leg areas of the body differently from support of the remainder of the body, and by doing so in a manner which more completely and effectively prevents bed sores from occurring on the heels and ankles of a bed-ridden person supported on the pad. Also, the pad provides a selectable body cooling feature which can be used or not used independently of the use of the pad for alternate pressure support of a person. The latter feature provides a pad which need not be exchanged for another if changes between body cooling and no body cooling are desired.

Generally speaking, according to a first aspect of this invention, an alternating pressure pad, useful between a mattress and the body of a bed-ridden person for the prevention or treatment of decubitus ulcers, comprises at least two super-posed air-impermeable flexible sheets. Each of the sheets is of selected thickness and all of the sheets are of substantially equal length and width with the length being greater than the width. The sheets are sealed together at selected locations thereof to define at least first and second pluralities of elongated, inflatable support chambers which extend generally in a widthwise direction across the pad length. The chambers within each plurality are interconnected for flow of air into and out of the chambers of that plurality through a port for that plurality. The chambers of the pluralities alternate with each other along the length of the pad throughout head and torso sections of the pad extending from a head end of the pad to a foot section of the pad and throughout the foot section extending from the torso section to a foot end of the pad. The chambers in the head and torso sections are each defined for inflation to substantially a first selected diameter while the chambers in the foot section are each defined for inflation to substantially a second selected diameter which is a selected amount less than the first diameter. The spacing between adjacent chambers is substantially equal through the area of the pad encompassed by the chambers. There are also means for coupling each port to an air supply mechanism which is cyclicly operable for supplying air at selected pressure for a predetermined time to each port in turn and for venting to atmosphere each other port so that the chambers in each plurality are inflated in turn while the chambers of the other pluralities are vented via their respective ports.

According to a second aspect of the invention, an alternating pressure pad, useful between a mattress and the body of a bed-ridden person for the prevention or treatment of decubitus ulcers, comprises at least three super-posed sheets of air-impervious flexible material. The sheets are each of selected thickness and all are of substantially equal length and width, there being bottom, intermediate and top sheets. The bottom and intermediate sheets are sealed together at selected locations thereof to define substantially over the area of the pad at least first and second pluralities of inflatable support chambers which are interconnected within each plurality for flow of air into and out of the chambers of that plurality through a port for that plurality. The chambers of the several pluralities which alternate with each other over said area of the pad. The chambers are defined for inflation to selected diameters. Means are provided for coupling each said port to an air supply mechanism. The air supply mechanism is cyclicly operable for supplying air at selected pressure for a predetermined time to each port in turn and for venting to atmosphere each other port so that the chambers in each plurality are inflated in turn while the chambers of the other pluralities are vented via their respective ports. The top and adjacent intermediate sheets of the pad are sealed together adjacent the edges of the sheets to define a further chamber which extends over substantially said area of the pad and which has a further port communicating to the further chamber. The top sheet defines through it a plurality of small air flow openings at selected locations according to a hole pattern which is substantially co-extensive with the area of the further chamber. The pad includes means for coupling the further port to a source of pressurized air for flow of air to the further chamber via the further port and through the holes.

DESCRIPTION OF THE DRAWINGS

The above-mentioned and other features of this invention are more fully set forth in the following description of the presently preferred and other embodiments of this invention, which description is presented with reference to the accompanying drawing wherein.

DESCRIPTION OF THE ILLUSTRATED EMBODIMENTS

Figure 1:
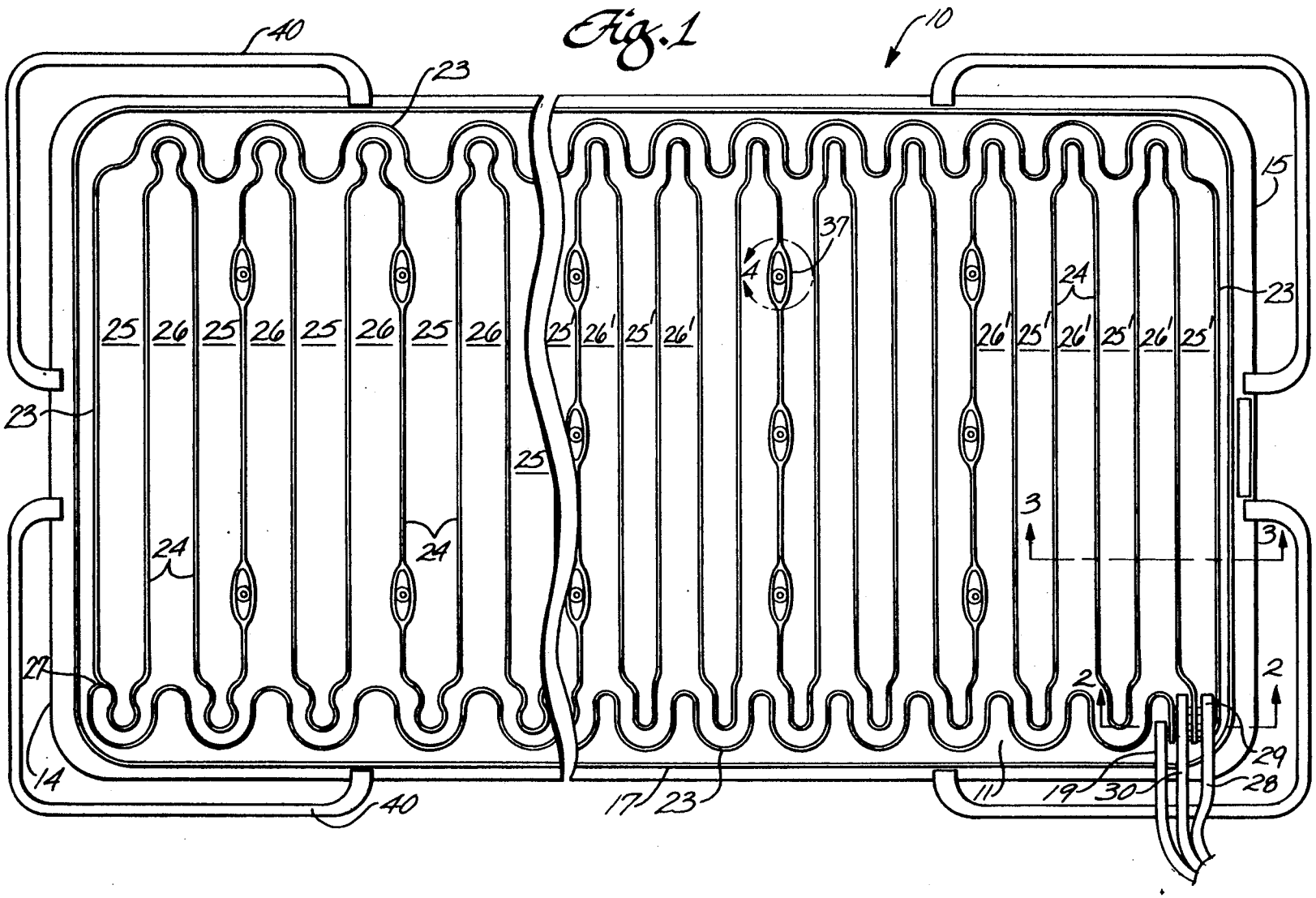
FIG. 1 is a bottom plan view of a presently preferred alternating pressure pad according to this invention.

A preferred alternating pressure pad 10 according to this invention is shown in the accompanying drawings. The pad is useful between a mattress and the body of a bed-ridden person for preventing and/or treating decubitus ulcers. As shown best in FIGS. 1, 2 and 3, pad 10 is comprised principally of three superposed sheets of an air-impermeable flexible material such as polyvinylchloride film. There is a bottom sheet 11, an intermediate sheet 12 and a cover or top sheet 13. The top sheet, as described more fully below, is finely perforated at selected locations distributed substantially uniformly over the extent of the top sheet. The bottom and intermediate sheets are not perforated and are truly air-impermeable. The several sheets are of substantially equal length and width and are longer than they are wide between a head end 14 and a bottom end 15 of the pad. In the presently preferred pad according to this invention, the pad is approximately 109 inches long and approximately 36 inches wide. The bottom, intermediate and bottom sheets preferably are 0.012 inches thick.

Figure 2:
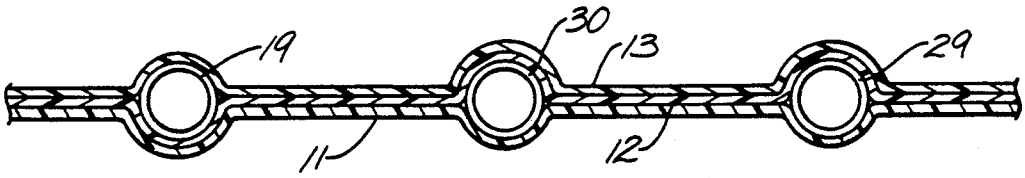
FIG. 2 is an enlarged cross-section view taken substantially along line 2—2 of FIG. 1.
Figure 3:
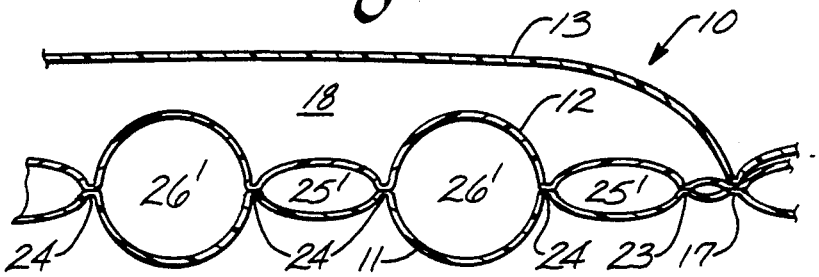
FIG. 3 is an enlarged cross-sectional view taken substantially along line 3—3 of FIG. 1.

A short distance inwardly from the edges of the sheets, the top and at least the intermediate sheet (preferably all of the sheets) are sealed together, as by radio frequency sealing, along a continuous seam line 17 which extends around the perimeter of the pad as best shown in FIG. see also FIG. 3. Thus, there is defined between the top and intermediate sheets 12 and 13 over substantially the entire area of the pad a body air chamber 18. Chamber 18, but for perforations 36 in top sheet 15 and for the provision of a port to the body chamber, is airtight. The port to body chamber 18 is defined by a tube 19 which has an open end within the body chamber and which extends from that open end between the top and intermediate sheets a selected distance outwardly beyond the adjacent edges of those sheets. Tube 19 preferably is located at the side of the pad near a corner of the pad at pad foot end 15. Tube 19 may be several feet long to extend to a coupling 20 (see FIG. 8) adapting the tube to be connected to a source of pressurized air for flow of air to the body air chamber via the tubes and the port defined by tube 19. Alternatively, as preferred in the practice of the invention, the port to body air chamber 18 is defined by a short tubular fitting which is sealed between the top and intermediate sheets 13 and 12 intermediate the fitting ends which lie within chamber 18 and outwardly of the edge of the pad where the fitting is connected in an essentially permanent manner to a suitable length of flexible tubing extending to coupling 20. The location of tube 19 between top and intermediate sheets 13 and 12, respectively, is shown best in FIG. 2.

As shown best in FIGS. 1 and 3, bottom sheet 11 and intermediate sheet 12 are sealed to each other, as by radio frequency sealing, along seams 23 and 24 inside seam 17. Seams 23 and 24 define a first plurality of body support chambers 25 and 25' and a second plurality of body support chambers 26 and 26'. Seam 23 extends from a beginning point 27 adjacent a head corner of the pad along the adjacent side edge of the pad, thence along the foot end of the pad, back up the opposite side of the pad and across the head end of the pad to seam beginning point 27 where it merges into, and is continued as, seam 24 which extends sinuously back and forth across the width of the pad inside seam 23 to an end point 28 at the pad foot corner where tube 19 communicates to body air chamber 18. At all portions along its extent seam 24 is spaced from seam 23 except at beginning point 27 of seam 23 where the two seams merge as described above. Seams 23 and 24 are so defined between sheets 11 and 12 that chambers 25, 25', 26 and 26' are elongated and extend in a width-wise direction across the length of the sheet. Seams 23 and 24 are so cooperatively formed between sheets 11 and 12 that chambers 25 and 25' are interconnected with each other along one side of the pad, whereas all of chambers 26 and 26' are interconnected with each other along the other side of the pad. Between the ends of the several support chambers, seam 24 preferably is straight with adjacent runs of the seam being parallel to each other. Except in the vicinities of top sheet connection points 37 (see FIGS. 4 and 5), seam 24 preferably is of constant width along its length in pad 10. The width of the seam preferably is one-eighth inch. All of chambers 25 and 25' are in air flow communication with each other, but are isolated from chambers 26 and 26' which are all in air flow communication with each other. The chambers of each plurality are interdigitated with those of the other plurality.

A port to chambers 25 and 25' is provided, preferably adjacent to tube 19, by a tube 29 which has one end disposed in chamber 25' closest to the foot end of the pad and which extends between sheets 11 and 12 to the exterior of the pad; sheets 11 and 12 are heat sealed to each other and to the tube in an appropriate manner well known in the pertinent art. Similarly, a port is provided to chambers 26 and 26' by a further tube 30 which has an open end disposed in the one of chambers 26' which lies closest to pad foot end 15 and which extends between sheets 11 and 12 to the exterior of the pad; tube 30 is sealed, as by radio frequency sealing, between sheets 11 and 12 between its open end in chamber 26' and the exterior of the chamber in a manner similar to that in which tube 29 is sealed between the same sheets. This is shown more clearly in FIG. 2.

As in the case of tube 19 which provides the air flow port to body air chamber 18, tubes 29 and 30 can extend continuously from pad 10 to corresponding places at coupling 20, or those tubes can be short fittings connected to the coupling by suitable lengths of flexible tubing engaged between the fittings and coupling 20; the latter is preferred.

Support chambers 25 and 26 alternate with each other along a head and torso section of the length of pad 10, whereas support chambers 25' and 26' alternate with each other throughout the length of a leg and heel section of the pad. The leg and heel section of the pad extends for about ⅓ of the length of the pad from its foot end 15 toward its head end 14; the balance of the length of the pad is occupied by the head and torso section.

Chambers 25 and 26 in the head and torso section of pad 10 are of substantially equal width so that when air at a selected pressure is applied to each of them, they inflate to a first selected diameter. Preferably, the spacing between adjacent runs of seam 24 which separates adjacent ones of chambers 25 and 26 is approximately 2.6 inches. In the leg and heel section of pad 10, however, the spacing between adjacent parallel runs of seam 24 is reduced so that each of chambers 25' and 26' is narrower, i.e., of smaller inflated diameter, than chambers 25 and 26. The spacing between adjacent parallel runs of seam 24 in the leg and heel portion of pad 10 preferably is approximately 2 inches so that the inflated diameter of each of chambers 25' and 26' are equal to each other but are a selected amount smaller than the inflated diameters of chambers 25 and 26 which, as noted above, preferably are equal.

The definition of chambers 25' and 26' to have smaller inflated diameters than their brothers in the head and torso section of the pad provides more effective support and pressure relieving cooperation with the heels and ankles of a person supported on the pad than would be achieved if the inflatable support chambers provided in the pad are made of equal diameter throughout the overall length of the pad. The use of support chambers of equal size along the entire extent of the pad has been found to be insufficient to meet the needs of the changing contours of the human body, especially in the critical heel and ankle areas. A person's heel and ankle prominences are much more sharply contoured than any of the other bony prominences on the human body, as a general rule. Thus, the present alternating pressure pad recognizes and corrects for the differences in weight distribution of the human body at the heel and ankle areas where body support forces on the skin are greater than at other locations such as the sacrum and trochanteric regions of the body.

In consideration of the comfort of the bed-ridden person supported by pad 10, chambers 25 and 26 in the head and torso section of the pad are defined to have large diameter and the support air pressure (i.e., the pressure of the air supplied to inflate chambers 25 and 26) is selected to be as low a pressure as possible consistent with support of the bony prominences of the supported body above the bed mattress when a support chamber below a prominence is inflated. Support chamber size and support air pressure are competing considerations. The larger the chamber diameter, the lower the inflation pressure can be for comfortable support of the person's body overall, but if the pressure is too low a bony body prominence may not be supported sufficiently well to be moved by the inflated chamber out of contact with the bed mattress, in which event the support chamber and the support air pressure have not performed their intended task.

A comfortable yet effective pad is produced by reducing the support chamber diameter in the leg and heel portion of the pad, the gap between adjacent transverse inflated chambers is reduced so that when the chamber directly below a heel is deflated, the leg and foot are held sufficiently high off the bed mattress by the adjacent inflated chambers that the heel will not contact the bed mattress and will see an interval when no pressure is applied to the skin at the heel. During such an interval, previously constricted capillaries in that area of skin can recover so that blood can flow through them for the desired time.

It is for these reasons (overall patient comfort and effective relief of pressure on the skin of a person's heel) that chambers 25' and 26' are defined to extend across the width of pad 10 and to have inflated sizes a selected amount smaller than the inflated sizes of their respective brother chambers 25 and 26. The spacing between adjacent chambers 25' and 26' is the same as the spacing provided between chambers 25 and 26.

In presently preferred pad 10, chambers 25' and 26' have inflated sizes which are about 44% smaller in area than the size of chambers 25 and 26 when inflated. The ratio of the inflated cross-sectional area of the larger chambers to the inflated cross-sectional area of the smaller chambers is in the range of from about 2.5 to about 1.25, the preferred area ratio being in the narrower ratio of 1.8 to 1.7. The diameters of chambers 25 and 26 relative to diameters of chambers 25' and 26' can be in the range of from about 8:1 to about 1.5:1. Chambers 25 and 26 can have inflated diameter in the range of from about 2 inches to about 4 inches; chambers 25' and 26' can have inflated diameters in the range of from about 0.5 inch to about 2 inches The preferred value of support air pressure in these chambers is 75 mm Hg. These characteristics, in combination, produce an alternating pressure pad 10 which provides substantially uniform and well distributed applications of supporting force on the body of a person lying on the pad. The supporting pressures experienced by the skin of the supported person in the important areas adjacent bony body prominence are correspondingly low and are uniform with the body support pressures provided elsewhere on the pad.

The provision of support chambers according to the forgoing criteria results in the interface pressures applied to the body at the critical support points being substantially uniform over these critical points with the interface pressure at the heel of the average person being less than that at the sacrum and trochanter.

An alternating pressure pad according to this invention has been found to provide alternating pressure relief well below capillary occlusion. In the deflated cycle of a chamber, the pad can achieve levels of interface pressure lower than those provided by a costly therapeutic bed system.

Figure 7:
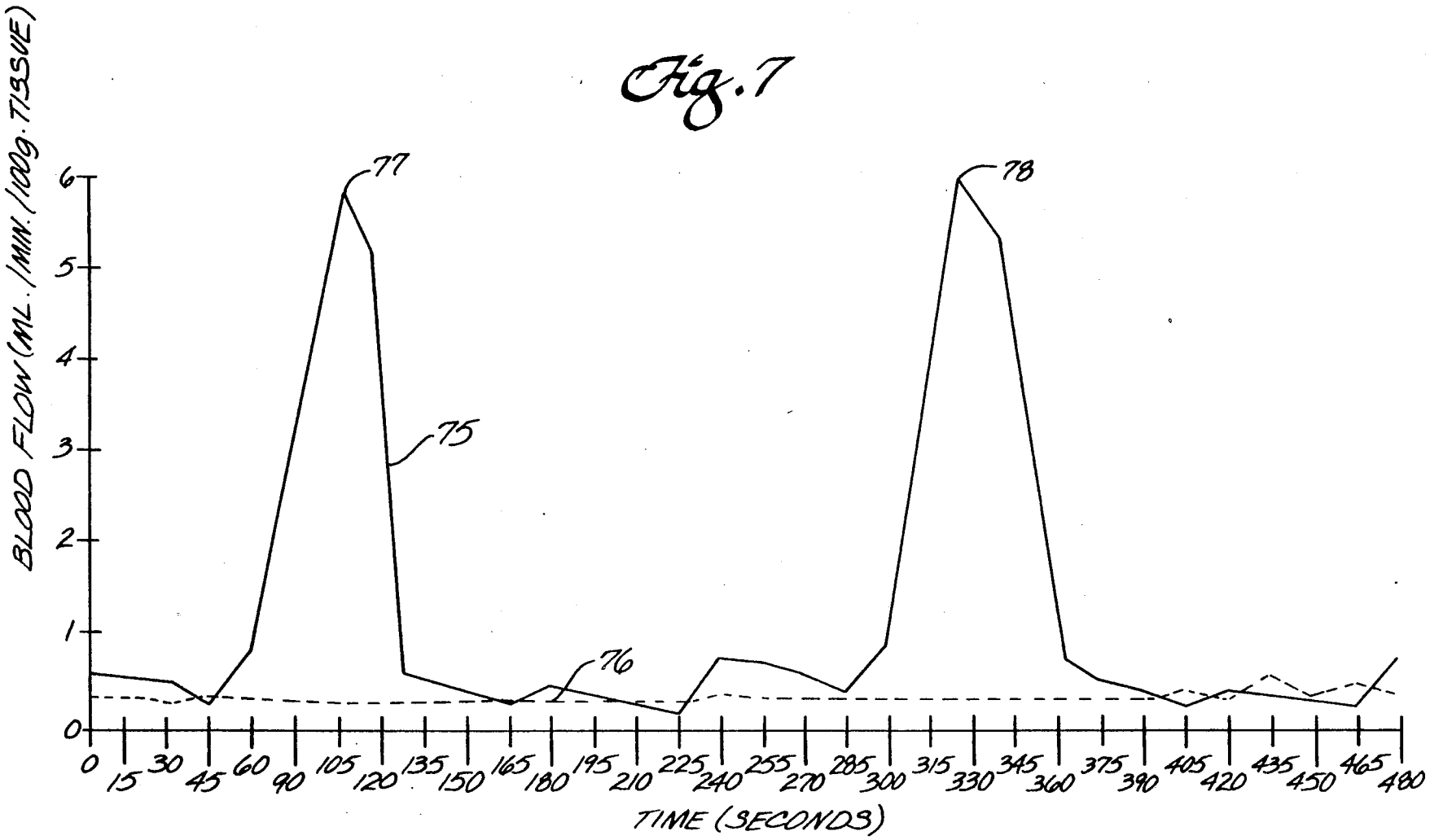
FIG. 7 is a graph which compares capillary blood flow with time for a person supported on an alternating pressure pad according to this invention and such flow in the capillaries of a person supported on a standard hospital mattress.

FIG. 7 is a graph which describes measured capillary blood flow rates in the skin under the heel of a person lying essentially immobile on his back on the preferred pad 10 according to this invention (the solid line 75 in the graph) and on a standard hospital mattress (dashed line 76). The data presented in FIG. 7 does not rely on inferences about capillary blood flow based upon the accepted standard that if the pressure applied to the skin is less than 32 mm. Hg., then capillary circulation is present at rates adequate to prevent the occurrence of decubitus ulcers (bed sores). The data presented in FIG. 7 was obtained from actual measurements of skin capillary blood flow at the heel. Such measurements were made using an infrared laser sensor which detects the rate of red blood cell movement in skin capillaries. Curve 75 in FIG. 7 shows that when the support chamber directly below the heel of a person supported on pad 10 was deflated, the pressure applied to the skin was relieved sufficiently to cause the capillary blood flow rate to rise from about 0.7 ml./min./100 g. of tissue to a peak flow rate of about 6 ml./min./100 g. of tissue. The 4 minute time internal between peaks 77 and 78 of curve 75 is the cycle rate of the controller used to operate pad 10. By comparison, curve 76 in FIG. 7 shows the capillary blood flow rate in the skin of a person lying substantially immobile on his back on a standard hospital bed mattress; that flow rate is about 0.4 ml./min./100 g. of tissue.

Figure 8:
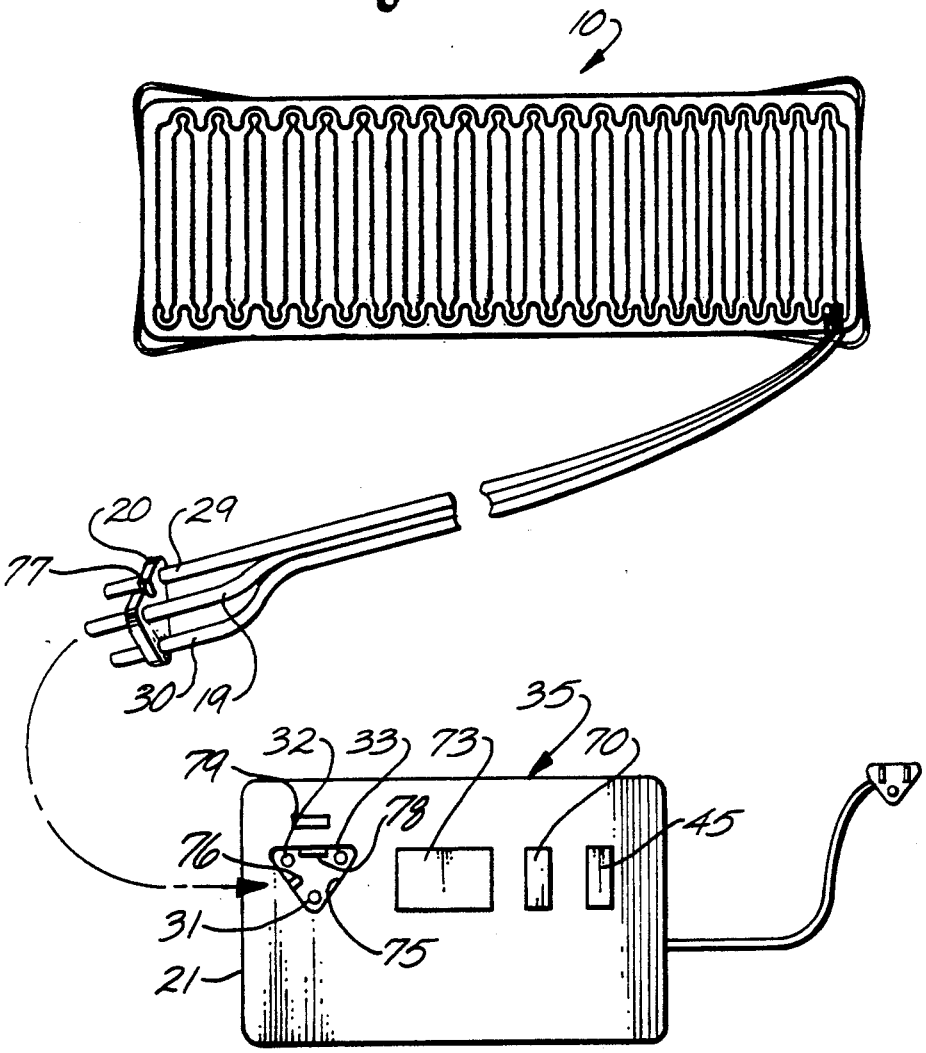
FIG. 8 is a simplified view which depicts how a pad according to this invention can be connected to a controllable source of air under pressure.

Coupling 20, to which the several ports to the body air chamber and the sets of body support chambers defined within pad 10 are separately connected, adapts those ports for connection to a controller and source of two different kinds of pressurized air. Coupling 20 preferably defines three tubular projections to which tubes 19, 29 and 30 are separately connected. Those projections are receivable in sockets 31, 32 and 33, respectively, which are accessible in a front face of a controller unit 35 as shown in FIG. 8. Socket 31 is associated with port 19 to body air chamber 18.

To assure that the several projections defined by coupling 20 are always inserted into the proper ones of the sockets 31–33 in the face of controller 35, the sockets open into a recess 75 in the controller face. There is in a side wall of the recess a key projection 76 which cooperates with a key slot 77 in an edge of coupling 20 only when the coupling is properly oriented in the recess. If the key projections and the key slot are not aligned, the coupling cannot be engaged with the controller. This arrangement assures that pad port 19 can be coupled only to socket 31 for supply of air at constant pressure to the pad, and that ports 29 and 30 can be coupled only to sockets 32 and 33 which receive pressurized air alternately.

There is a latch member 78 which cooperates between the controller in recess 75 and coupling 20 when the latter is seated in the recess to retain the coupling in the recess. The latch can be released from the coupling by movement of a release lever 79 located adjacent the recess in the face of the controller.

As will be described in greater detail below, when coupling 20 is engaged with the controller, air at selected pressure, preferably at about 75 mm mercury, can be supplied alternately to ports 29 and 30 to alternately inflate support chambers 25 and 25' on the one hand, and support chambers 26 and 26' on the other hand. The duration of one complete cycle of such alternate pressurization of the support chambers in the pad preferably is four minutes so that a given portion of the body is supported by one of the support chambers for about two minutes followed by a period of like duration in which that same portion of the body is free of body support forces. During the period in which the skin is not subjected to significant body support forces by a support chamber, capillaries in the skin and adjacent flesh can recover from any occlusion thereof experienced during the preceding period of application of body support forces to them, as shown in FIG. 7.

Figure 6:
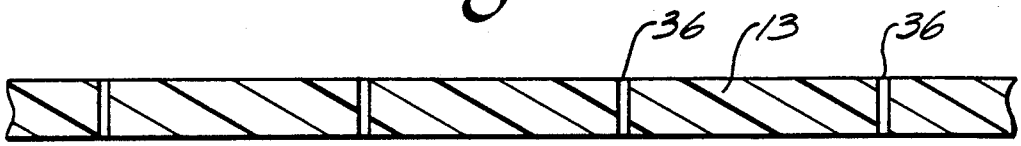
FIG. 6 is a cross-sectional elevation view through the top on cover sheet of the pad shown in FIG. 1

FIG. 6 is a cross-sectional elevation view of top sheet 13 of pad 10 and shows that this sheet is very finely perforated, as at 36, at each of a number of locations distributed substantially regularly over the entire area of sheet 13. It is preferred that the open area of sheet 13 as defined by holes 36 be about 0.0005% of the total area of the sheet. This open area figure results in a flow of air through the presently preferred pad at the rate of about 18 standard cubic feet per hour, the pressure in body air chamber 18 being about ¼ inch water. Such air flow, during times when body cooling of a person supported on the pad is desired, keeps the person substantially dry and comfortable. Keeping the person dry contributes to prevention of decubitus ulcers. However, a situation may arise, such as the supported person being dehydrated, in which body cooling is not desired. Pad 10 can be used in a noncooling mode simply by shutting down the supply of pressurized air to chamber 18 without interrupting the alternating supply of air under pressure to support chambers 25, 25', 26 and 26'. This aspect of pad 10 is contrasted from previously known body-cooling, alternating pressure pads where body cooling air is derived from the body support chambers in the pad through holes formed at selected locations in the top wall of at least some of the body support chambers. If body cooling is achieved by bleeding air from the body support chambers of an alternating pressure pad, it is necessary to supply air at rather high volumes to the pad.

Figure 4:
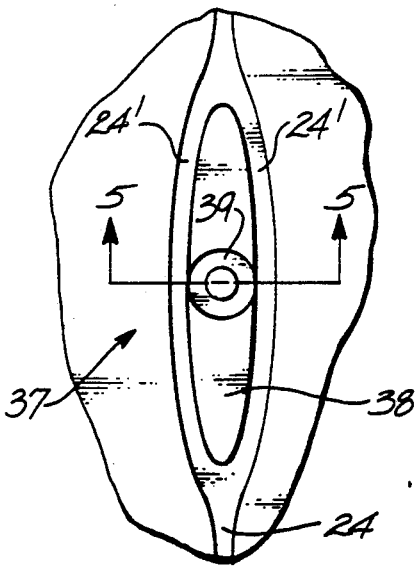
FIG. 4 is an enlarged fragmentary plan view taken within the portion of FIG. 1 encircled by broken line marked "4;"
Figure 5:
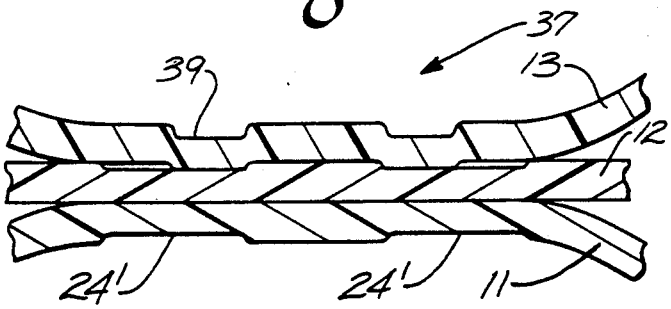
FIG. 5 is a further enlarged cross-section view taken along line 5—5 of FIG. 4.

To prevent unnecessary ballooning of top sheet 13 above intermediate sheet 12 when body air chamber 18 is pressurized for use of pad 10 in its body cooling mode, it is preferred, as shown in FIG. 1, that the top sheet be connected to intermediate sheet 12 at selected locations over the area of chamber 18. Such a connection point 37 is shown in detail in FIGS. 4 and 5. FIG. 4 shows that in the vicinity of a connection point 37, seam 24, which connects the bottom and intermediate sheets together, divides into branches 24' which diverge and then rejoin, thereby providing between them an area 38 in which sheets and 12 are not connected. Centrally of this area between seam branches 24', the top sheet is connected to the intermediate sheet by a circular seam 39. The preferred sequence of manufacture of pad 10 is to first join the bottom and intermediate sheets together through the agency of seams 23 and 24, and then to connect the top sheet to the intermediate sheet via the agency of peripheral seam 17 and local connection points 37. The preferred manner of making these connections is by radio frequency sealing, and therefore, at connection points 37, the top, intermediate, and bottom sheets are effectively all interconnected as shown in FIG. 5 where the indentations in the respective sheets represent the preferably heat sealed connections of the sheets to each other.

The manufacture of pad 10 preferably is completed by connecting to the pad, in the vicinity of each of its four corners, a hold-down strap 40 which can be defined by a length of polyvinylchloride film strip having the same thickness as the film used to define the bottom and intermediate sheets of the pad. The ends of each hold-down strap are connected, as by radio frequency sealing, to the margin of the pad at selected distances from the adjacent corner so that each hold-down strap is loose between its connected ends. In use of the pad, the pad is placed on top of a mattress and the hold-down strap loops are engaged under the respective corners of the mattress.

Figure 9:
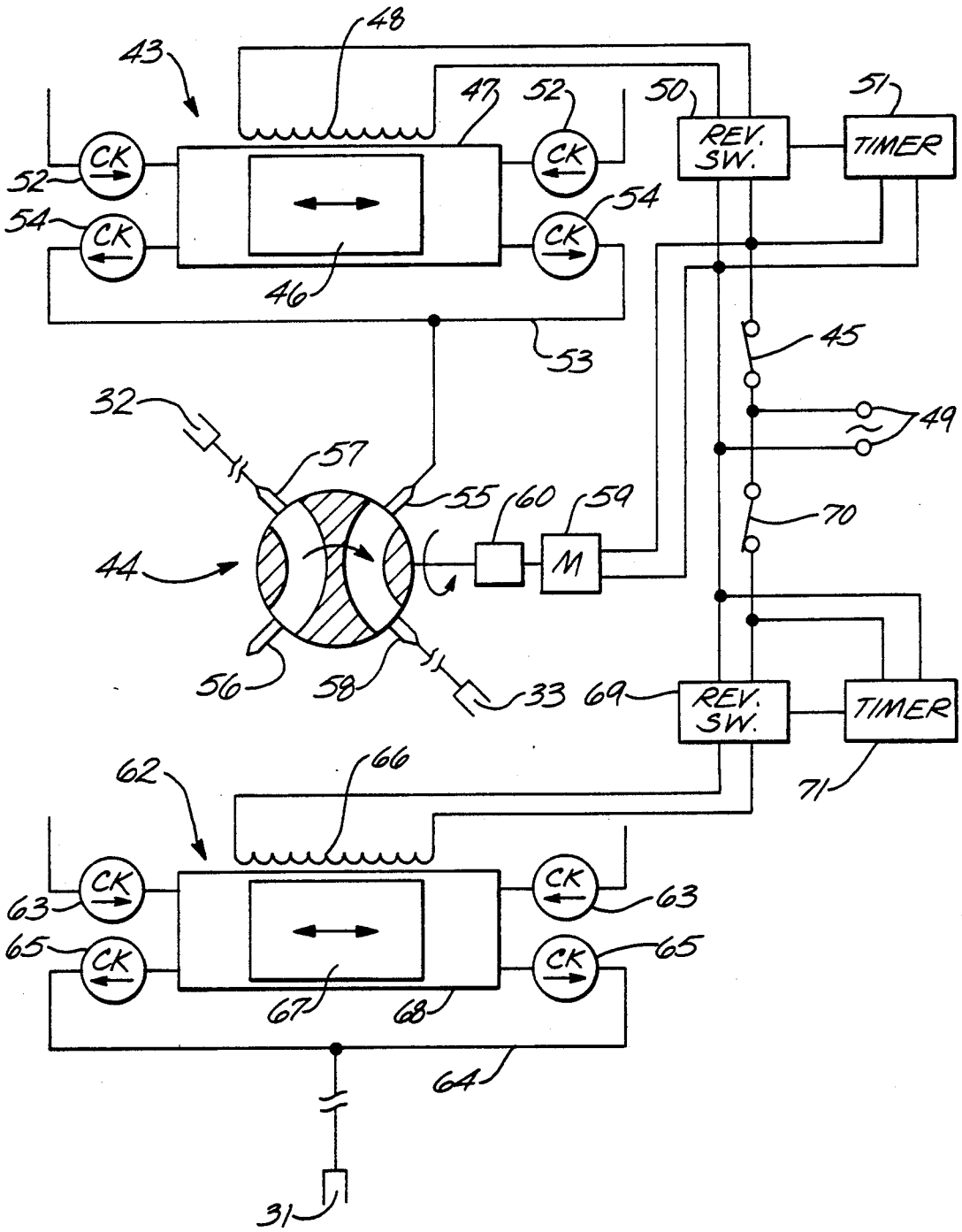
FIG. 9 is a schematic diagram depicting the electrical and pneumatic components of a useful air supply mechanism.

FIG. 9 is a schematic diagram depicting certain of the electrical and pneumatic components of a controller 35 which can be used to operate pad 10 in both its alternating pressure relieving and body cooling modes of operation; the controller, as such, is not a part of this invention. As noted above, the body cooling mode is optional and can be selected at will. Air at the desired inflation pressure is supplied in controller 35 to support chamber ports 29 and 30 via sockets 32 and 33 from an air compressor 43 through a switching and venting valve 44. Compressor 43 is an electrically powered mechanism, the operation of which can be selected in an on-off manner by operation of a switch 45 accessible on the face of controller 35. A useful air compressor is a double-acting, free piston air pump which includes a ferromagnetic piston 46 which is reciprocable back and forth within a pump cylinder 47 in response to alternation of the polarity of a magnetic field generated in a coil 48 surrounding the pump cylinder. Reversal of the col field is achieved by coupling the coil across energization terminals 49 of the circuit through switch 45 and a polarity reversing switch 50. The reversing switch is operated in a cyclic manner by a timer 51 coupled in parallel with the reversing switch.

Compressor 43 receives air from atmosphere at the opposite ends of its cylinder through inlet check valves 52 and discharges air under pressure from the cylinder ends to a common manifold 53 through outlet check valves 54. Compressed air manifold 53 is connected to a supply inlet port 55 which comprises one port of four-port switching valve 44 which can be of the rotary plug type. Additional ports of switching valve 44 are a vent port 56 and first and second pressure outlet ports 57 and 58 which are coupled to sockets 32 and 33, respectively, in the face of controller 35. Valve 44 can be operated by a motor 59 through a gear box 60. Motor 59 can be connected in parallel with reversing switch 50 so that motor 59 is turned on at the same time as compressor 43 is turned on by closure of switch 45. Valve 44 operates to alternately connect sockets 32 and 33 to the pressure outlet ports of the valve, thereby to alternately pressurize body support chambers 25 and 25', and 26 and 26', respectively, via coupling 20 which is then engaged in a proper manner with the sockets at the face of the controller.

In view of the selectively usable body cooling feature of pad 10, controller 35 includes a second compressor 62 which preferably is of the same general kind, if not precisely the same kind, as compressor 43. Compressor 62 receives air from atmosphere through inlet check valves 63 and discharges compressed air to a manifold 64 through outlet check valves 65. Manifold 64 is connected to pneumatic coupling socket 31 in the face of the controller. Energization of a coil 66 for reciprocating a ferromagnetic free piston 67 within the cylinder 68 of compressor 62 is controlled by polarity reversing switch 69. An on-off switch 70 for compressor 62 is connected between reversing switch 69 and the power input terminals 49 of the controller. A timer 71 is connected to reversing switch 70 to operate the switch at appropriate intervals between the two different states of the switch. The controller may also include an audio-visual indicator or alarm 73 for signalling the event of a disconnection of coupling 20 from the controller during either mode of operation of pad 10.

Operation of compressor 62 is independent of operation of compressor 43. Therefore, the body cooling feature of pad 10 can be used or not used at will during use of the pad for alternating pressure support of a person lying on the pad.

The ratings of compressors 43 and 62 can be and preferably are the same. Compressor 43 inflates the body support chambers of pad 10 to a preferred inflation pressure of 75 mm. mercury. In view of the net air flow area from body air chamber 18 provided by openings 36 in pad top sheet 13, compressor 62 is effective to deliver air at the rate of 18 standard cubic feet per hour to chamber 18 and to maintain in that chamber a steady-state pressure of about one-fourth inch of water.

The foregoing description and the accompanying drawing describe and show the presently preferred alternating pressure pad according to this invention and a controller and pressurized air source which can be used with the preferred pad. It will be appreciated that these descriptions and illustrations are not exhaustive of all forms in which the invention can be embodied. Workers skilled in the art to which this invention most closely pertains will appreciate that alterations, modifications and variations upon the structures and procedures described can be practiced without departing from the innovative and art-advancing scope of the invention. For example, the body support chambers can be other than straight over their elongate extents in the pad, different pad locating or hold-down arrangements may be used, different combinations of support chamber sizes and/or inflation pressures can be used, and different kinds of pressurized air sources and controls for them can be used, to name only a few such alterations. Therefore, the following claims are to be read and applied accordingly to afford them their proper scope and meaning, rather than as pertaining only to the particular structures and procedures which have been described and shown.

What is claimed is:

1. An alternating pressure pad useful between a mattress and the body of a bed-ridden person for the prevention or treatment of decubitus ulcers, the pad comprising at least two superposed air-impermeable flexible sheets each of selected thickness and all of substantially equal length and width with the length being greater than the width, the sheets being sealed together at selected locations thereof to define at least first and second separate pluralities of elongated inflatable support chambers which extend across the pad length and which are interconnected only within each plurality for flow of air into and out of the chambers of each plurality through a port for that plurality, the chambers of the pluralities alternating with each other along the length of the pad throughout head and torso sections of the pad extending from a head end of the pad to a foot section of the pad and throughout the length of the pad, means for coupling each port to an air supply mechanism cylically operable for supplying air at selected pressure for a predetermined time to each port in turn and for venting to atmosphere each other port so that the chambers in each plurality are inflated in turn while the chambers of the other pluralities are vented via their respective ports, the aforesaid sheets including a bottom sheet and at least one intermediate sheet between which the support chambers are defined, a top sheet overlying the topmost intermediate sheet and sealed thereto to define a body air chamber which extends in width and length over a substantial portion of the area of the pad and which has a further port communicating thereto separately from the support chambers and from the ports to the support chambers, the top sheet defining through it a plurality of small air flow openings at selected locations according to a hole pattern which is substantially coextensive with the area of the body air chamber, the top sheet and the sheet subjacent thereto being connected together at selected locations within the perimeter of the body air chamber, and means for coupling the further port to a source of pressurized air for flow of air to the body air chamber via the further port and through said openings.

2. Apparatus according to claim 1 wherein the air flow area of the top sheet within the perimeter of the body air chamber is about 0.0005% of the area top sheet within the perimeter of the body air chamber.

3. An alternating pressure pad useful between a mattress and the body of a bed-ridden person for the prevention or treatment of decubitus ulcers, the pad comprising at least two superposed air-impermeable flexible sheets each of selected thickness and all of substantially equal length and width with the length being greater than the width, the sheets include a bottom sheet and at least two intermediate sheets which are sealed together at selected locations thereof to define at least first and second separate pluralities of elongated inflatable support chambers which are of substantially constant configuration along their lengths, which extend in a widthwise direction ac ross the pad length and which are interconnected only within each plurality for flow of air into and out of the chambers of each plurality through a port for that plurality, the chambers of the pluralities alternating with each other along the length of the pad throughout head and torso sections of the pad extending from a head end of the pad to a foot section of the pad and throughout the foot section extending from the torso section to a foot end of the pad, the chambers in the head and torso sections each being defined for inflation to substantially a first selected diameter and the chambers in the foot section each being defined for inflation to substantially a second selected diameter which is a selected amount less than the first selected diameter, the spacing between adjacent chambers being substantially equal through the area of the pad encompassed by the chambers, and means for coupling each port to an air supply mechanism cyclically operable for supplying air at selected pressure for a predetermined time to each port in turn and for venting to atmosphere each other port so that the chambers in each plurality are inflated in turn while the chambers of the other pluralities are vented via their respective ports, and the sheets comprising the pad further include a top sheet overlying the topmost intermediate sheet and sealed thereto to define a body air chamber which extends in width and length over a substantial portion of the area of the pad and which has a further port communicating thereto separately from the support chambers and from the ports to the support chambers, the top sheet defining through it a plurality of small air flow openings at selected locations according to a hole pattern which is substantially coextensive with the area of the body air chamber, the top sheet and the sheet subjacent thereto being connected together at selected locations within the perimeter of the body air chamber, and means for coupling the further port to a source of pressurized air for flow of air to the body air chamber via the further port and through said openings.

* * * * *